United States Patent [19]

Casey

[11] Patent Number: 4,643,359

[45] Date of Patent: Feb. 17, 1987

[54] MINI INJECTOR VALVE

[75] Inventor: Gary L. Casey, Troy, Mich.

[73] Assignee: Allied Corporation, Morris Township, Morris County, N.J.

[21] Appl. No.: 713,369

[22] Filed: Mar. 19, 1985

[51] Int. Cl.[4] ..... B05B 1/30

[52] U.S. Cl. ..... 239/585; 251/129.15

[58] Field of Search ..... 239/585; 251/129.15, 251/129.21, 129, 139

[56] References Cited

U.S. PATENT DOCUMENTS

| | | | |
|---|---|---|---|
| 4,274,598 | 6/1981 | Wilfert et al. | 239/585 |
| 4,494,701 | 1/1985 | Hensley et al. | 239/585 |
| 4,509,693 | 4/1985 | Nakai | 239/585 |
| 4,552,311 | 11/1985 | Casey | 239/585 |

*Primary Examiner*—Joseph F. Peters, Jr.
*Assistant Examiner*—Michael J. Forman
*Attorney, Agent, or Firm*—Markell Seitzman; Russel C. Wells

[57] ABSTRACT

A mini-injector valve having a valve seat member, a movable armature, a stator, a coil spring, and solenoid coil disposed in a magnetically permeable housing. The valve seat member has an axial passageway connected to the apex of a conical valve seat. The armature has a peripheral flange adjacent to the internal walls of the housing and an axial valve stem for engaging the conical valve seat to occlude the axial passageway. The armature is magnetically insulated from the housing by a non-magnetic bushing which coaxially supports the armature for reciprocation in the housing. The solenoid coil is wound on a plastic bobbin molded onto the stator providing excellent magnetic coupling between the solenoid coil and the stator. The coil spring circscumscribes the armature between the peripheral flange and the bobbin, and biases the armature away from the stator and the valve stem into engagement with the conical valve seat. The mini-injector valve has a linear fluid delivery in response to electrical signals having a pulse widths down to 1.1 milliseconds.

41 Claims, 13 Drawing Figures

MINI INJECTOR VALVE

BACKGROUND OF THE INVENTION

1. Field of the Invention

The invention is related to the field of fluid injector valves, and, in particular, to small size, high speed, electrically actuated fluid injector valves for inejecting fuel into internal combustion engines.

2. Prior Art

The current trend in automotive fuel control systems is to electronically compute the fuel requirements of the internal combustion engine and provide the determined quantity of fuel to the engine through electrically actuated fuel injector valves. There is a concerted effort by the automotive industry to upgrade the performance capabilities of these injector valves, improve their reliability and reduce their costs. Currently, the fuel injector valves used in the automotive industry are labor intensive requiring a relatively large number of machined parts having close tolerances and require complex assembly and calibration procedures.

This problem was initially addressed in my co-pending patent application Ser. No. 535,009 filed Sept. 23, 1983, now U.S. Pat. No. 4,552,371, issued Nov. 12, 1985, entitled "A Low Cost Unitized Fuel Injection System". This patent application discloses an injector valve having a conical valve seat engaged by a stem valve and specifically designed to reduce the number of machined parts.

The present invention is a miniature fluid injector valve designed to further reduce the number of parts and to eliminate to a maximum extent the number of parts having to be machined to close tolerances. The resultant fluid injector is not only easier to assemble and calibrate, but also has superior operating characteristics.

SUMMARY OF THE INVENTION

The invention is a solenoid actuated fluid injector valve of the type having a magnetically permeable housing defining a cylindrical chamber, a valve seat member having an axial fluid passageway therethrough and a conical valve seat disposed at one end of the chamber, and a linearly displaceable valve stem for engaging the conical valve seat to close the axial passageway. The injector valve is characterized by an armature connected to and supporting the valve stem coaxially with the valve seat member's fluid passageway. The armature having a cylindrical body and a peripheral flange at the end of the cylindrical body adjacent to the valve seat member. The peripheral flange has a diameter smaller than the internal diameter of the chamber. A thin non-magnetic bushing is disposed between the armature and the housing for slidably supporting the armature concentric in the cylindrical chamber. A stator having an axial portion concentric with the armature and a radial flange at the end opposite the armature is fixedly attached to the housing with the end of the axial portion spaced a predetermined distance from the armature. A solenoid assembly having a solenoid coil and a bobbin sealed to and extending along the entire length of the axial portion of the stator. The bobbin having an end face facing the armature. A coil spring circumscribing the body of the armature between the armature's peripheral flange and the bobbin's end face for producing a predetermined force biasing the armature away from the stator and the valve stem into engagement with the conical valve seat.

The primary advantage of the mini-injector is its fast response and high speed capabilities. Another advantage is its simple construction and the elimination of complex machined parts which significantly reduce its manufacturing cost. These and other advantages of the invention will become more apparent from a reading of the detailed description of the invention in conjunction with the drawings.

DETAILED DESCRIPTION OF THE INVENTION

Figure 1:
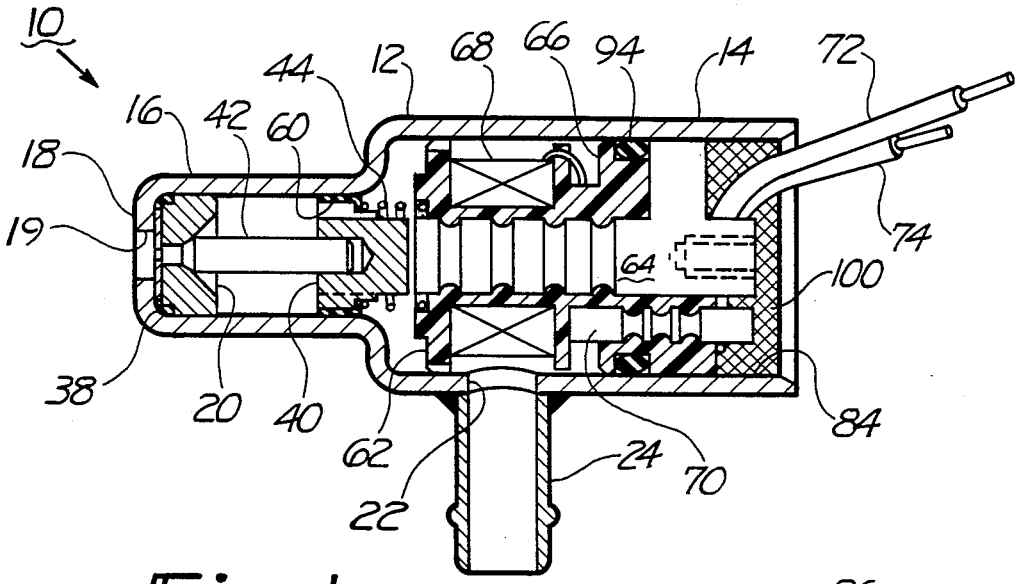
FIG. 1 is a cross-sectional side view of the mini-injector valve.

FIG. 1 is a cross-sectional view showing the details of the mini-injector valve 10. The mini-injector valve comprises an external housing 12 made from a magnetic permeable material such as a low carbon or 400 series stainless steel. The housing 12 has a body portion 14 and a contiguous necked down portion 16. The end of the necked down portion 16 is partially enclosed by an integral annular end cap 18 having a 2.5 millimeter axial aperture 19. The end cap 18 forms a seat for valve seat assembly 20 as shall be described hereinafter.

To appreciate the size of the mini-injector, the length of the housing 12 is only 35.6 millimeters (1.4 inches) and the diameter of the body portion is 15 millimeters (0.6 inches).

The housing 12 has a fluid entrance port 22 which connects the interior of the housing with a fluid inlet tube 24. The inlet tube 24 may be welded or brazed to the housing 12 using any of the techniques well known in the art. The fluid entrance port 22 and inlet tube 24 may provide a fluid inlet to the housing 12 through the body portion 14, as shown, or through the necked down portion 16 (not shown) as would be obvious to one skilled in the art.

Figure 2:
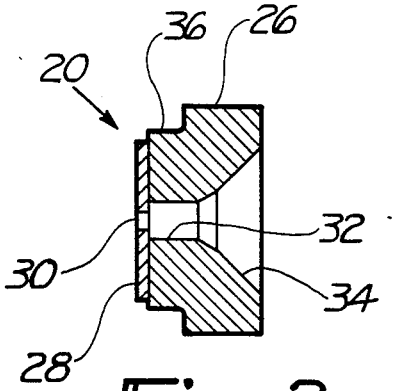
FIG. 2 is an enlarged cross section of the valve member.

The valve seat assembly 20 comprises a seat member 26 and an orifice plate 28 and shown in FIG. 2. The orifice plate 28, whose thickness is exaggerated in FIG. 2, is preferably a thin stainless steel plate approximately 0.05 to 0.07 millimeters (0.002 to 0.003 inches) thick with a central metering orifice 30. The diameter of the metering orifice 30 may be fixed or may vary in accordance with the viscosity and/or desired fluid injection rates. The seat member 26 has an axial fluid passageway 32 concentric with the metering orifice 30 of the orifice plate 28 but has a larger diameter so that it has no influence over the rate at which the fluid is injected through the metering orifice 30. A conical valve seat 34 is provided at the end of the axial fluid passageway 32 opposite the orifice plate 28. The seat member 26 also includes an "O" ring groove 36 for an O ring type seal 38 as shown in FIG. 1. The valve seat assembly 20 is formed by bonding the orifice plate 28 to the seat member 26 using a high strength retaining material, such as Loctite RC/1680 manufactured by Loctite Corporation of Newington, Conn.

Figure 3:
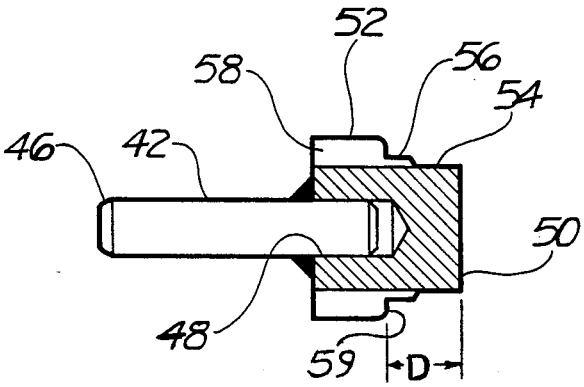
FIG. 3 is an enlarged cross section of the armature assembly.
Figure 4:
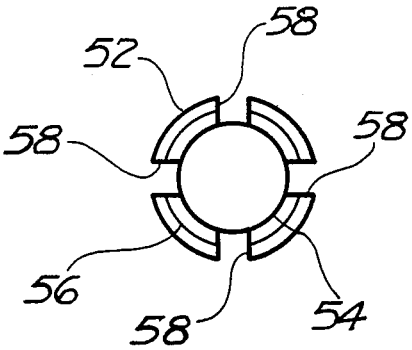
FIG. 4 is an end view of the armature assembly.

A valve stem 42 of an armature assembly 40 is resiliently biased by coil spring 44 to engage the conical valve seat 34 of the seat member 26 and close fluid passageway 32. As shown more clearly in FIG. 3, the valve stem 42 has a spherical end surface 46 which engages the conical valve seat 34 of the seat member 26. The other end of the valve stem 42 is received in an axial aperture 48 of an armature 50 and laser welded in place.

The armature 50 has a peripheral flange 52, a boss 54 and an intermediate land 56. The flange 52 has a plurality of longitudinal fluid vents such as slots 58 about its periphery which permit a fluid flow past the armature assembly 40. The shoulder between the flange 52 and the intermediate land 56 forms a seat for coil spring 44.

Figure 5:
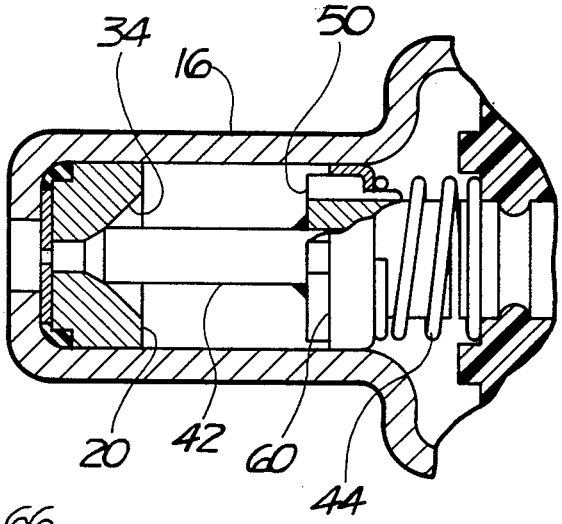
FIG. 5 is an enlarged partial cross section of the forward portion of the mini-injector.

As shown more clearly in FIG. 5, which is an enlarged segment of FIG. 1, a non-magnetic bushing 60, approximately 0.1 millimeters (0.004 inches) thick, is disposed between the armature 50 and the internal surface of the necked down portion 16 of housing 12. The bushing 60 has a lip abutting the rear surface of the flange 52 about its periphery. The inner diameter of bushing's lip is larger than the diameter of the intermediate land 56 and therefore does not impede the fluid flow through the slots 58 of the armature's flange 52. The bushing 60 is made from a non-magnetic material such as copper, brass, aluminum, nickel or a non-magnetic stainless steel. The bushing 60 performs a dual function, first it acts as a bushing or bearing supporting the armature assembly 40 for reciprocation in the housing 12 concentric with the valve seat assembly 20, and secondly, the bushing 60 functions as a non-magnetic spacer maintaining a predetermined spacing between the armature 50 and the interior walls of housing 12. This prevents direct contact between the armature 50 and the housing 12 which would otherwise result in a high magnetic attractive force being generated between these elements. This high magnetic force would significantly increase the sliding friction between the armature and the housing impeding the reciprocation of the armature and increasing the response time of the mini-injector valve.

Alternatively, the bushing 60 may be eliminated and the peripheral surfaces of the armature's flange 52 or the adjacent internal surface of the housing 12 be coated and/or plated, to a comparable thickness, with a non-magnetic material, such as copper, nickel, a plastic or a ceramic.

Referring back to FIG. 1, an integral stator/solenoid assembly 62 is disposed in the body portion 14 of the housing 12. The stator/solenoid assembly 62 comprises a magnetically susceptible stator 64, a plastic bobbin 66 molded directly onto the stator 64, and a solenoid coil 68 wound on the bobbin 66. A pair of electrodes 70, only one of which is shown in FIG. 1, are molded into the plastic bobbin 66 and are electrically connected to the ends of the solenoid coil 68. External electrical leads, such as leads 72 and 74, are individually connected to the electrodes 70 to provide electrical power to the solenoid coil 68.

Figure 6:
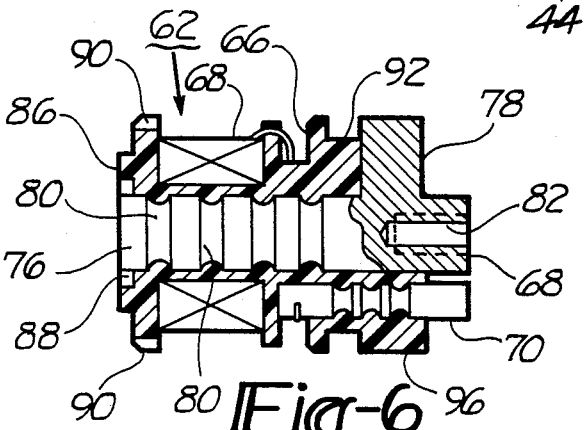
FIG. 6 is a cross section of the solenoid assembly.
Figure 7:
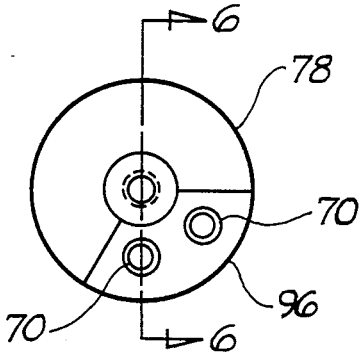
FIG. 7 is a rear view of the solenoid assembly.
Figure 8:
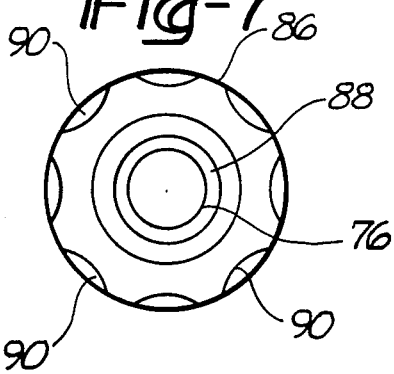
FIG. 8 is a front view of the solenoid assembly.

Referring to FIGS. 6, 7 and 8, the stator 64 has an axial pole 76 and an integral sectored flange 78. The axial pole 76 has a plurality of circumferential grooves 80 provided along its length and an axial threaded bore 82 provided at the end adjacent to flange 78. The flange 78 has a diameter which is slightly smaller than the internal diameter of the housing's body portion 14 so that the stator/solenoid assembly 62 can be slidably inserted into the housing 12 through the open end 84 of the housing 12. Alternatively, the axial pole 76 and flange 78 may be separate elements welded together with holes provided in the flange 78 for the electrodes 70 to pass through. As shown in FIG. 7, the electrodes 70 pass through the open portion of the sectored flange 78 and are surrounded by the structural plastic material of the bobbin 66.

The bobbin 66 is made from a structural plastic such as RYNITE 546, a glass reinforced polyester manufactured by E.I. DuPont de Nemours and Company of Wilmington, Del., which, in the preferred embodiment, is molded directly onto the stator's axial pole 76. The plastic material of the bobbin 66 fills the grooves 80 of the stator's axial pole 76 axially locking the bobbin 66 to the stator and forming a leak tight seal therebetween. The bobbin's forward flange 86 has an annular recess 88 circumscribing the stator's axial pole 76. The annular recess 88 is a seat for the coil spring 44.

A plurality of cutouts or notches 90 are provided about the periphery of flange 86 as shown on FIG. 8. These notches permit an unimpeded fluid flow from the inlet tube 24 to the interior of the housing's necked down portion 16 as required. If the fluid entrance port 22 and inlet tube 24 provide a fluid entrance into the necked down portion of the housing 12, the notches 90 about the periphery of flange 86 are not required. An O-ring seat 92 is formed at the opposite end of the bobbin 66 adjacent to the stator's sectored flange 78 for retaining an "O" ring 94, as shown in FIG. 1. The "O" ring 94 provides a fluid seal between the stator/solenoid assembly 62 and the housing 12 effectively sealing the open end of housing 12.

The electrodes 70 are molded directly into the bobbin 66 and extend through the open portion of the stator's sectored flange 78 as shown. The rear end 96 of the bobbin 66 fills in the open portion of the stator's sectored flange 78 and provides additional structural support to the electrodes 70.

The solenoid coil 68 is wound on the bobbin 66 with its opposite ends soldered to the electrodes 70 as shown. In the preferred embodiment, the solenoid coil comprises approximately 300 turns of #32 wire. The insulation coating on the wire is preferably a fuel resistant coating to prevent deterioration when used with hydrocarbon fluids, such as gasoline or alcohol, which might otherwise dissolve the insulation.

Figure 9:
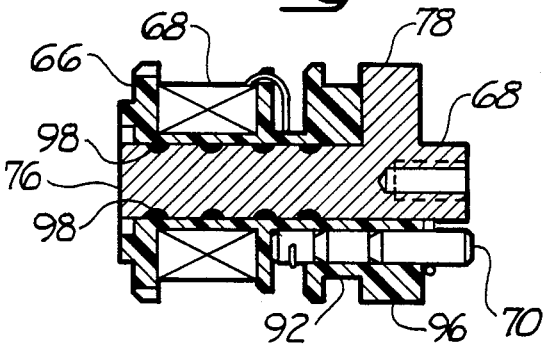
FIG. 9 is a cross section of an alternate embodiment of the solenoid assembly.

An alternate embodiment of the stator/solenoid assembly 62 is illustrated in FIG. 9. In this embodiment, the bobbin 66 is formed separately and not molded directly around the stator's axial pole 76. The bobbin 66 is bonded to the axial pole 76 using a high strength bonding material 98 such as Loctite RC/680 manufactured by Loctite Corporation of Newington, Conn. The bonding material 98 completely fills the axials pole's circumferential grooves 80 providing a resilient fluid tight seal between the bobbin 66 and stator 64 and locks the bobbin 66 to the axial pole 76 preventing longitudinal displacement between these elements. The electrodes 70 may be molded into the bobbin 66 as previously discussed relative to the embodiment of FIG. 6 or may be bonded into bores provided in the bobbin with the same bonding material used to bond the bobbin 66 to the stator 64.

Referring to FIG. 1, the stator/solenoid assembly 62 is inserted into the housing 12 and its position adjusted to have a predetermined spacing between the rear face of the armature 50 and the front face of the stator's axial pole 76. The spacing between the armature 50 and the stator's axial pole 76 is adjusted so that when the armature is retracted in response to energizing the solenoid coil 68, the valve stem 42 is withdrawn from the valve seat 34 a distance sufficient so that the fluid flow through the metering orifice 30 is determined primarily by the size of the metering orifice and trimmed to the desired flow rate by the position of the valve stem 42 relative to valve seat 34.

The diameter of the orifice is nominally selected so that if the fluid flow were unimpeded by the position of the valve stem 42 relative to the valve seat 34, the flow through the metering orifice 30 would be approximately 10% greater than that required. The lift of the valve stem 42 from the valve seat 34 is then adjusted with a fluid flowing through the orifice to obtain the desired fluid flow rate. This adjustment capability removes the requirement for extreme accuracy of the size of the orifice. In older valve designs, this type of adjustment is not practical because slight stroke variations cause excessive changes in the response characteristics of the valve.

The spacing between the armature 50 and stator's pole 76 is accomplished during assembly using a special calibration fixture. This calibration fixture (not shown) provides for a fluid flow through the mini-injector valve and has a threaded shaft which is received in the threaded bore 82 provided in the end of the stator 64. In the calibration procedure the solenoid is actuated, then the threaded shaft is rotated to adjust the position of the stator/solenoid assembly 62 until the desired fluid flow rate is obtained. After the adjustment is completed, the housing 12 is crimped in 3 or 4 places adjacent to the stator's sectored flange 78 to lock the stator/solenoid assembly 62 in the housing. The sectored flange is then laser welded or bonded to the housing 12 using Loctite or a similar adhesive. The rear end of the housing 12 is then filled with a potting material 100 to complete the assembly of the mini-injector 10.

The opening and closing times of the mini-injector valve are to a large extent determined by the force exerted by coil spring 44. Higher spring forces increase the opening time of the valve and decrease the closing time while lower spring forces produce the opposite effect. Conventional fuel injectors used in internal combustion engines have opening times only slightly shorter than the minimum injection times required for accurate flow control at low delivery rates. Typically, in minimum injection times of these injectors range from 2.2 to 2.5 milliseconds while the opening times are approximately 1.6 milliseconds. Consequently, small changes in the spring force, which affect the opening and closing times of the valve, will produce relatively large changes in the fuel flow rate as the injection time approaches the minimum injection time. To overcome this problem the spring is manually adjusted, while the valve is operating, to calibrate the injector at low flow rates. This is a time consuming labor intensive procedure which increases the cost of the injector.

In contrast, the mini-injector valve due to its smallness and the light weight of its armature, has a very short opening time which is less than one half of the opening time of the conventional fuel injectors. Typically, the opening time of the mini-injector valve is about 0.7 milliseconds. As a result, variations in the spring force will have a much lesser affect on the fuel flow at the minimum injection times. One of the novel features of the mini-injector valve is that the calibration of the force exerted by coil spring 44 is performed prior to assembling the valve. This is accomplished by measuring, prior to assembly, the compressed height at which each coil spring 44 produces the desired force. After this height is determined, a mating armature assembly 40 and a stator/solenoid assembly 62 are selected in which the spacing between the armature's flange 52 and the bobbin's annular recess 88 is the same as the compressed height of the coil spring which produces the desired force. For this selection process, the depth of the recess 88 relative to the face of the stator's axial pole 76 will be premeasured and the stator/-solenoid assemblies 62 stored according to the recorded depth. Correspondingly, a plurality of armature assemblies 40 will be made available to the assembler. This plurality of armatures will have different distances "D", where "D" is the distance between the rear face of the boss 54 and the rear surface of the flange 52 as indicated on FIG. 3. All the assembler has to do is select a stator/-solenoid assembly 62 and an armature assembly in which the sum of the distance D and the depth of recess 88 equal the compressed height of the coil spring which produces the desired force. It has been found that this selective assembly procedure results in a fluid flow calibration at minimum injection times which is just as accurate but less complex than the calibration procedures used for conventional fuel injectors.

In the alternative, the distance D could always be made a little longer than required, and the calibration adjust made by selecting a washer type spacer to be inserted between the spring and the armature's flange.

Because the calibration of the force exerted by the coil spring 44 is made prior to assembly, there is no need to provide for any subsequent adjustment of the spring force. This permits the spring 44 to be placed forward of the stator and in a position with the housing 12 which is otherwise inaccessible for adjustment, thus saving space. In particular the location of the spring 44 forward of the stator's axial pole permits the bobbin 66 to be disposed directly over the stator's pole member reducing the gap between the stator and the solenoid coil to a minimum and enhancing the magnetic coupling between the solenoid coil and the stator's pole member. This arrangement further reduces the internal diameter of the solenoid coil and permits the use of a smaller diameter coil wire, which in turn reduces the outside diameter of the solenoid. These factors combined to reduce the overall outside diameter of the mini-injector to approximately 15 millimeters (0.6 inches).

Another advantage of placing the coil spring 44 forward of the stator is that the coil spring will have a larger diameter and a smaller length to diameter ratio. This makes the spring more stable, increases its durability and reduces its tendency to buckle.

Figure 13:
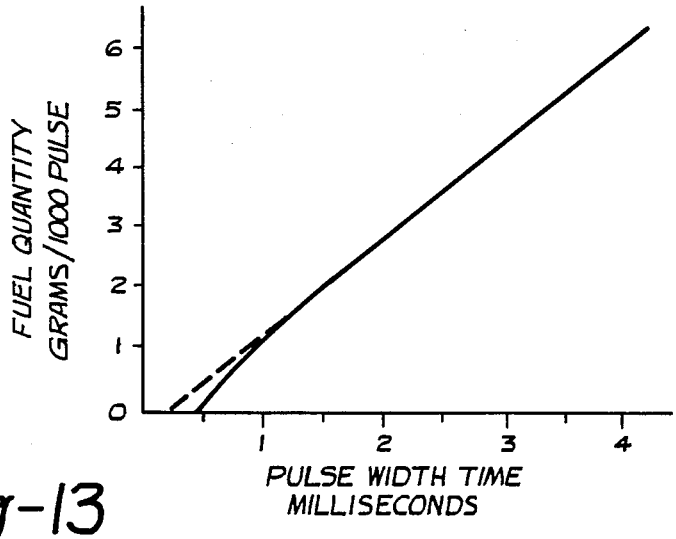
FIG. 13 is a graph showing the linearity of mini-injector valve's output as a function of excitation pulse width.

FIG. 13 is a graph illustrating the operational characteristics of the mini-injector valve. As shown on the graph, the quantity of fuel delivered by the mini-injector valve is a linear function of the pulse width of the electrical signal activating the solenoid coil 68 for all pulse widths longer than 1.1 milliseconds. It is only for pulse widths shorter than 1.1 milliseconds that the fluid output becomes nonlinear having a cut off at approximately 0.4 milliseconds.

The mini-injector is about twice as fast as a conventional fuel injector whose fluid output ceases to be a linear function for signals having pulse widths less than 2.2 to 2.5 milliseconds. The faster response of the mini-injector is the result of faster opening and closing times of the valve due to the smaller size and weight of the armature assembly 40 and the enhanced coupling between the solenoid coil 68 and the stator 64. With a fluid pressure of 25 psi and 12 volt square wave pulses, the opening time of the mini-injector is approximately 0.7 milliseconds and the closing time is approximately 0.5 milliseconds. Again these opening and closing times are about one-half those of conventional injector valves.

Figure 10:
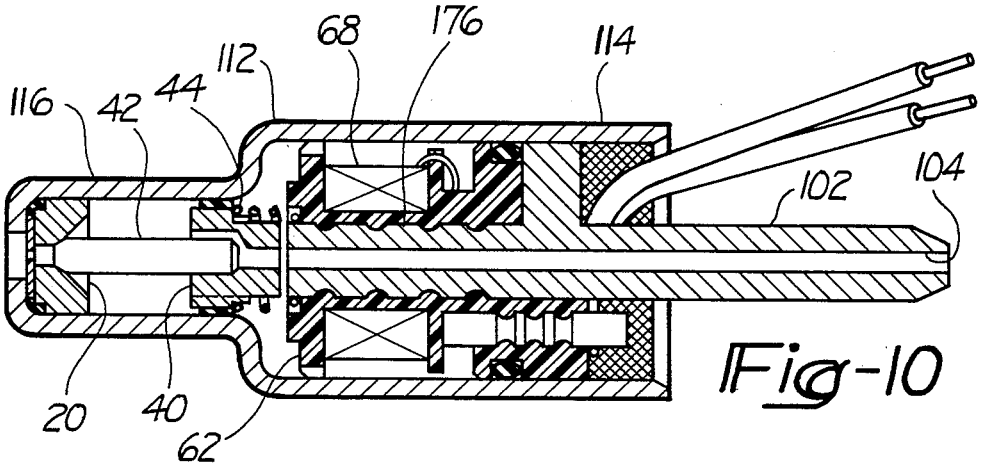
FIG. 10 is a cross-sectional side view of an alternate embodiment of the mini-injector.

An alternate embodiment of the mini-injector 10 is shown in FIG. 10 in which a fuel inlet is provided through the stator. In FIG. 10, the elements of the mini-injector valve, which are the same as shown in FIG. 1, are identified by the same numerals. Referring to FIG. 10, the mini-injector has a housing 112 which has a body portion 114 and a necked down portion 116 and for all practical purposes is identical to housing 12, except that the fluid entrance port 22 and inlet tube 24 are omitted. The valve seat assembly 20, armature assembly 40, coil spring 44 and stator/solenoid assembly 62 are disposed in the housing 112 having the same relationship as described with reference to the embodiment of FIG. 1. However in this alternate embodiment, the stator's axial pole 176 has an axial extension 102 which protrudes from the end of the housing 112 and constitutes a fluid inlet tube. Accordingly, an axial fluid passageway 104 is provided through the axial extension 102 and the axial pole 176 into the interior of housing 112. The bobbin 66 is molded or bonded to the stator's axial pole 176 and the solenoid coil 68 wound on the bobbin 66 to form the stator/solenoid assembly 62 as previously described relative to the embodiment of FIG. 1.

Figure 12:
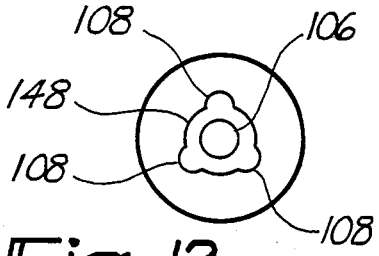
FIG. 12 is a front view of the armature of FIG. 11.
Figure 11:
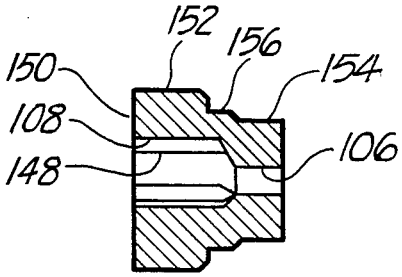
FIG. 11 is a cross-sectional side view of the armature for the embodiment shown on FIG. 10.

The details of the armature 150 of the armature assembly 40 are shown on FIGS. 11 and 12. Referring first to FIG. 12, the armature 150 has a peripheral flange 152, a boss 154 and an intermediate land 156 corresponding to the flange 52, boss 54 and intermediate flange 56 of armature 50 shown on FIG. 3. As more clearly shown on FIG. 12, armature 150 also has an axial aperture 148 for receiving the valve stem 42 which is welded therein as previously described. The axial aperture 148 extends through the armature 50 and mates with the fluid passageway 104 passing through the stator. The axial aperture 148 may have a necked down portion 106 at the end adjacent to the stator as shown, or may have the same diameter over its entire length. A plurality of grooves 108 are provided about the periphery of axial aperture 148 to provide for a fluid flow through the armature around the valve stem 42. The grooves 108 may extend entirely through the armature of may be terminated at a point intermediate the end of the valve stem 42 and the end face of the boss 154 as shown on FIG. 11.

The operation of the mini-injector valve illustrated in FIG. 10 is the same as previously described with reference to the embodiment of FIG. 1. The only differences between these two embodiments being the location of th fluid input port.

Having described the mini-injector valve in detail, it is submitted that one skilled in the art will be able to make certain changes in the structure illustrated in the drawings and described in the specification without departing from the spirit of the invention as set forth in the appended claims.

What is claimed is:

1. A solenoid actuated fluid injector valve of the type having a magnetically permeable housing defining an cylindrical chamber, a valve seat member having an axial fluid passageway connected to a conical valve seat disposed at one end of said chamber and a linearly displaceable valve stem for engaging the conical valve seat to close the fluid passageway, said housing further including an outlet, downstream of said fluid passageway, and a fluid inlet port, upstream of said fluid passage, an improvement characterized by:

an armature connected to the valve stem, said armature having a cylindrical body and a peripheral flange provided at an end of said cylindrical body, said peripheral flange having a diameter smaller than the diameter of the cylindrical chamber;

non-magnetic means disposed between said armature and the housing for slidably supporting said armature concentrically in the cylindrical chamber;

a stator having an axial pole concentric with said armature and a radial flange connected to said axial pole at a first end opposite said armature, said radial flange fixedly attached to said housing with a second end of said axial pole spaced a predetermined distance from said armature;

a solenoid assembly having a plastic bobbin sealed to the stator's axial pole and extending along the length of the stator's axial pole and a solenoid coil wound on said bobbin; and a coil spring circumscribing the cylindrical body of said armature between said bobbin and said peripheral flange for producing a predetermined force biasing said armature away from said stator and said valve stem into engagement with said conical valve seat.

2. The fluid injector valve of claim 1 having an orifice plate disposed adjacent to said valve seat member, said orifice plate having a metering orifice concentric with said valve seat member's axial fluid passageway.

3. The fluid injector valve of claim 2 wherein the size of said metering orifice is selected to produce a fluid flow rate greater than the desired fluid flow rate and wherein the predetermined distance between the armature and the stator's axial pole is selected to cause the fluid flow rate through the metering orifice to be equal to the desired fluid flow rate.

4. The fluid injector valve of claim 1 wherein the cylindrical chamber formed by the housing has a forward necked down portion housing the valve seat member and said armature and a body portion housing said stator and said solenoid assembly.

5. The fluid injector valve of claim 4 wherein said housing has an end cap partially enclosing the end of said housing's necked down portion, said fluid injector further having an orifice plate disposed between said end cap and the valve seat member, said orifice plate having a metering orifice provided therethrough concentric with the valve seat members axial passageway.

6. The fluid injector valve of claim 4 wherein said bobbin is molded onto said stator's axial pole.

7. The fluid injector valve of claim 6 wherein said axial pole has at least one circumferential groove longitudinally locking said molded bobbin to said axial pole.

8. The fluid injector valve of claim 6 wherein said bobbin includes a pair of electrodes connected to ends of said solenoid coil and wherein said stator's radial flange has a cut out portion adjacent to said electrodes to provide for external electrical connection to said electrodes.

9. The fluid injector valve of claim 4 wherein said bobbin is bonded to the stator's axial pole piece to form a fluid tight seal therebetween.

10. The fluid injector valve of claim 9 wherein said bobbin includes a pair of electrodes connected to ends of said solenoid coil and wherein said stator's radial flange has a cut out portion adjacent to said electrodes to provide for external electrical connection thereto.

11. The fluid injector valve of claim 1 wherein said fluid inlet port is provided through the wall of said housing.

12. The fluid injector valve of claim 1 wherein a fluid inlet port is provided axially through said stator.

13. The fluid injector valve as defined in claim 1 wherein said spacing means includes a thin non-magnetic bushing disposed between a peripheral flange of said armature and said housing.

14. The fluid injector valve as defined in claim 1 wherein said fluid inlet port is upstream of said armature and said armature includes first flow means for communicating fluid to said fluid passageway.

15. The fluid injector valve as defined in claim 14 wherein said first flow means includes said radial flange which includes slots extending therethrough.

16. The fluid injector valve as defined in 15 wherein said fluid inlet port is proximate said bobbin, and said bobbin further includes second flow means for permitting fluid to flow from said inlet port to said armature.

17. The fluid injector valve as defined in claim 1 wherein said bobbin includes at least one radial flange, and said injector valve further includes sealing means disposed between said radial flange and said cylindrical body.

18. A fluid injector valve comprising:

a magnetically permeable housing enclosing a cylindrical chamber having a necked down portion, including an inner surface, partially enclosed at one end by an annular end cap and a contiguous body portion open at an end opposite said necked down portion;

a valve seat member fixedly disposed in said necked down portion adjacent to said annular end cap, said valve seat member having a conical valve seat concentric with said necked down portion and an axial passageway through said valve seat member;

an armature assembly concentrically disposed in said necked down portion, said armature assembly having a cylindrical body, an integral peripheral flange provided at one end of the cylindrical body, and a valve stem extending axially from said cylindrical body towards said conical valve seat, said peripheral flange extending adjacent to the inner surface of said necked down portion of the housing;

means for non-magnetically separating said armature's peripheral flange from the internal surface of said necked down portion of said housing;

a stator disposed in said body portion of said cylindrical chamber, said stator having an axial pole member and a radial flange connected to the pole member at a first end opposite said armature, said radial flange fixedly attached to said housing with a second end of said axial pole member concentric with and spaced a predetermined distance from said armature;

a solenoid assembly having a plastic bobbin sealed to and extending along the length of said stator's axial pole member and a solenoid coil wound on said bobbin;

a coil spring positioned between the armature's peripheral flange and the plastic bobbin for producing a force biasing said armature away from said stator and said valve stem into engagement with said conical valve seat; and fluid input means for providing a fluid flow into said cylindrical chamber, and an outlet proximate said necked down portion in fluid communication with said fluid input means through said axial passageway of said valve seat member.

19. The injector valve of claim 18 having an orifice plate disposed between the annular end cap and said valve seat, said orifice plate having a metering orifice concentric with said valve seat member's fluid passageway.

20. The injector valve of claim 19 wherein said orifice plate is fixedly attached to said valve seat member.

21. The injector valve of claim 19 wherein said metering orifice has a diameter selected to provide a fluid flow greater than the desired fluid flow and wherein said predetermined distance between said armature assembly and said stator is adjusted to provide a fluid flow through said metering orifice equal to said desired fluid flow.

22. The injector valve of claim 18 wherein the end of said valve stem engaging said conical valve seat is spherical.

23. The injector valve of claim 18 wherein said plastic bobbin is molded onto said axial pole member.

24. The injector valve of claim 23 wherein said axial pole member has at least one circumferential groove filled by said molded bobbin to form a fluid tight seal between said axial pole member and said bobbin and to longitudinally lock said bobbin to said stator.

25. The injector of claim 23 wherein said bobbin includes a pair of electrodes electrically connected to corresponding ends of said solenoid coil wherein said stator's radial flange has a cut out section adjacent to said pair of electrodes to provide for external electrical connectio to said pair of electrodes.

26. The injector valve of claim 18 wherein said bobbin is bonded to said axial pole member to form a fluid tight seal therebetween and longitudinally lock said bobbin to said stator.

27. The injector valve of claim 26 wherein said bobbin has a pair of longitudinal electrodes electrically connected to corresponding ends of said solenoid coil and wherein said stator's radial flange has a cut out section adjacent to said pair of electrodes to provide for external electrical connection to said pair of electrodes.

28. The injector valve of claim 18 wherein said fluid input means is a fluid inlet port provided through said housing.

29. The injector valve of claim 18 wherein said fluid input means is an axial fluid passageway provided through said stator's pole member.

30. The injector valve of claim 18 wherein said means for non-magnetically separating is a non-magnetic bushing disposed between the stator's peripheral flange and the inner surface of said housing's necked down portion.

31. The injector valve of claim 18 wherein said means for non-magnetically separating is a coating of a non-magnetic material provided on the peripheral surface of said armature's peripheral flange.

32. The injector valve of claim 18 wherein said means for non-magnetically separating is a coating of a non-magnetic material provided on the internal surface of said housing adjacent to said armature's peripheral flange.

33. A mini-injector valve comprising:

a magnetically permeable housing defining an internal chamber having a necked down portion, and a contiguous body portion, one end of said necked down portion being partially enclosed by an annular end cap having an axial aperture;

a valve seat member disposed in said necked down portion adjacent to said annular end cap, said valve seat member having an axial passageway therethrough and a conical valve seat concentric with said axial passageway;

an armature concentrically disposed in said necked down portion, said armature having a flange portion and a cylindrical boss;

a valve stem coaxially attached to said armature and having a spherical end surface for engaging said conical valve seat;

a non-magnetic bushing disposed between said armature's flange portion and the internal surface of said necked down portion;

a stator disposed in said body portion, said stator having an axial pole member axially displaced a predetermined distance from said armature, and a radial flange connected to said housing to structurally support said axial pole member concentric with said armature;

a plastic bobbin concentrically disposed around said axial pole member and joined thereto in a fluid tight relationship, said bobbin mating with said radial flange at one end and substantially extending the length of said axial pole member;

a solenoid coil wound on said bobbin;

a pair of electrodes disposed in said bobbin connected to ends of said solenoid coil;

a coil spring disposed around said armature's boss between said flange portion and said plastic bobbin for producing a force urging said armature away from said stator and said valve stem into engagement with said valve seat; and fluid means including an inlet port for providing a fluid flow into the interior of said housing between said valve seat member and said stator's radial flange and an outlet port in communication with said inlet port, disposed downstream of said axial passageway.

34. The mini-injector valve of claim 33 wherein said fluid inlet means is an inlet port provided through said housing intermediate said valve seat member and said stator's radial flange.

35. The mini-injector valve of claim 33 wherein said fluid means includes an axial extension extending from said radial flange on the side opposite said pole member and including an axial passageway passing through said extension and said pole member.

36. The mini-injector of claim 35 wherein a passageway is provided through said armature concentric with said axial passageway passing through said extension and said pole member.

37. A solenoid actuated fluid injector valve of the type having a magnetically permeable housing defining an cylindrical chamber, a valve seat member having an axial fluid passageway connected to a conical valve seat disposed at one end of said chamber and a linearly displaceable valve stem for engaging the conical valve seat to close the fluid passageway, said housing further including an outlet, downstream of said fluid passageway, and a fluid inlet port, upstream of said fluid passage, an improvement characterized by:

an armature connected to the valve stem, said armature having a cylindrical body and a peripheral flange provided at an end of said cylindrical body, said peripheral flange having a diameter smaller than the diameter of the cylindrical chamber;

non-magnetic means disposed between said armature and the housing for slidably supporting said armature concentrically in the clyindrical chamber;

a stator having an axial pole concentric with said armature and a radial flange connected to said axial pole at a first end opposite said armature, said radial flange fixedly attached to said housing with a second end of said axial pole spaced a predetermined distance from said armature;

a solenoid assembly having a plastic bobbin extending along the length of the stator's axial pole and a solenoid coil wound on said bobbin; and a coil spring disposed between said bobbin and said peripheral flange for producing a predetermined force biasing said armature away from said stator and said valve stem into engagement with said conical valve seat.

38. The fluid injector as defined in claim 37 wherein said plastic bobbin is sealed to the stator's axial pole.

39. The fluid injector as defined in claim 37 further including an orifice plate disposed between said valve seat and said housing.

40. The fluid injector valve as defined in claim 37 wherein said bobbin includes at least one radial flange, and said injector valve further includes sealing means disposed between said radial flange and said cylindrical body.

41. The fluid injector valve as defined in claim 40 wherein said at least one radial flange of said bobbin is positioned proximate the radial flange of said stator.

* * * * *